US009611015B1

(12) United States Patent
Borg

(10) Patent No.: US 9,611,015 B1
(45) Date of Patent: Apr. 4, 2017

(54) FLOATING BOARD DEVICE

(71) Applicant: Vincent Edward Borg, Big Pine Key, FL (US)

(72) Inventor: Vincent Edward Borg, Big Pine Key, FL (US)

( * ) Notice: Subject to any disclaimer, the term of this patent is extended or adjusted under 35 U.S.C. 154(b) by 0 days.

(21) Appl. No.: 15/211,052

(22) Filed: Jul. 15, 2016

Related U.S. Application Data

(60) Provisional application No. 62/194,287, filed on Jul. 20, 2015.

(51) Int. Cl.
*B63B 35/73* (2006.01)
*B63B 35/79* (2006.01)
*A45F 3/04* (2006.01)

(52) U.S. Cl.
CPC ..... *B63B 35/7906* (2013.01); *A45F 3/04* (2013.01)

(58) Field of Classification Search
CPC ... A45F 3/15; B63B 35/7906; B63B 35/7909; B63B 2035/738; B63C 11/46
USPC ..... 441/35
See application file for complete search history.

(56) References Cited

U.S. PATENT DOCUMENTS 5,117,577 A * 6/1992 Burghoff ..... A01K 97/02 43/44.99
5,171,178 A * 12/1992 Creek ..... B63B 35/78 441/132
5,402,596 A * 4/1995 Gillming, Jr. ..... A01K 97/06 206/315.11
5,618,215 A * 4/1997 Glydon ..... B63B 1/34 114/67 R
6,345,744 B1 * 2/2002 Eldridge ..... A01M 31/00 220/560
7,011,089 B2 * 3/2006 Tokatlian ..... B63C 11/202 128/201.27
7,281,488 B1 * 10/2007 Sanders ..... B63B 29/04 114/363
D569,194 S * 5/2008 Chang ..... D7/605
8,672,719 B2 * 3/2014 Grimes ..... B63B 35/73 114/364
8,745,792 B2 * 6/2014 McGlynn ..... A61G 1/00 5/625
8,915,010 B1 * 12/2014 Gardner ..... A01K 97/02 220/560
2003/0153221 A1 * 8/2003 Weir ..... B63B 35/7913 441/66
2012/0122357 A1 * 5/2012 Eckert ..... B63B 35/7906 441/79
2015/0076194 A1 * 3/2015 Sidwa ..... B63B 35/7946 224/259
2016/0096598 A1 * 4/2016 Harkrider ..... A47C 15/006 441/130
2016/0152306 A1 * 6/2016 VanNimwegen ..... B63C 13/00 114/347

* cited by examiner

*Primary Examiner* — Joshua Kennedy
(74) *Attorney, Agent, or Firm* — Mario Roitman

(57) ABSTRACT

A portable floating board device for various water activities such as swimming, diving, fishing, and emergency use. The floating board device includes a secure platform to sit or stand. The board includes an anchor system and storage system. The board may be carried by handles or by straps attached to the bottom side of the board for easy portable.

3 Claims, 5 Drawing Sheets

FLOATING BOARD DEVICE

CROSS REFERENCE TO RELATED APPLICATIONS

The present application claims priority to U.S. Provisional Patent Application No. 62/194,287, filed on Jul. 20, 2015.

FIELD OF THE DISCLOSURE

This disclosure relates generally to floating devices, more specifically to a portable floating water sports board.

BACKGROUND

Floating devices for water activities in the ocean, lake, river, or pool are utilized and built for a variety of applications. Many of these floating devices are designed for specific uses such as for various sports or for leisure. These floating devices serve a specific purpose such as a surf board for surfing, knee board for water skiing, kick board for swimming, or an inflatable floating device for leisure and relaxation.

Generally, these types of floating devices don't allow for the conveniences offered by boats such as storage, anchors, or secure platforms to stand and sit. Therefore, fisherman, divers, and other water enthusiast require at least a small boat or vessel to accommodate supplies and to keep safe while fishing, diving, snorkeling, or swimming. The present invention solves these issues allowing for portable floating vessel to be used by water sports enthusiasts and families as an alternative to small boats for activities such as diving, fishing, snorkeling, and swimming in open waters. In addition, boating and water sports businesses, as well as resorts may use the present invention as a safety device or recreational activity. The present invention may be Coast Guard approved as a safety device on boats.

SUMMARY OF INVENTION

The following summary provides a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

In one aspect, the present invention provides for a portable staging area for water sports enthusiasts such as snorkelers, spear fishing enthusiasts, or lobster divers. The present invention would provide a buoyant platform on which a diver or snorkeler may keep his gear and catches while diving.

In another aspect, the present invention provides for a safe platform for divers, fisherman, and children to use while resting between dives or swimming in the water. During various breaks in diving or snorkeling, users may use the present invention to rest in areas that are further from the coast or shore.

In another aspect, the present invention provides for a portable floating device where divers, swimmers, fisherman, or any water enthusiasts may carry the device as a backpack or for easy transportation in a boat or automobile.

In another aspect, the present invention provides an inexpensive and convenient alternative to a small boat for fishing, diving, or leisure. The present invention may provide a more practical and portable water vessel for water enthusiasts compared to a small boat which requires high maintenance costs, large storage space, and less portability.

In yet another aspect, the present invention provides for a water vessel to carry supplies and equipment out in the water. In addition, the present invention provides a storage area for supplies, equipment, food, beverages, as well as freshly caught fish and shellfish.

In another aspect, the present invention may be used as a safety flotation device for use on boats. Currently, the Coast Guard approves life rings as a preservation and safety device for use on boats in case of emergencies. The present invention may also be Coast Guard approved and be used on boats for preservation and safety device during emergencies and catastrophic events.

In yet another aspect, the present invention may be used by commercial water sports businesses and resorts as a sports board and safety device. Many businesses and resorts have boating, boarding, and other waters sports activities and the present invention may be utilized by these businesses and resorts as an additional activity and/or safety device.

Still other aspects of the present invention will become readily apparent to those skilled in this art from the following description wherein there is shown and described example embodiments of this invention, simply by way of illustration of the best modes suited to carry out the invention. The invention is capable of implementation in other different embodiments, and its several details are capable of modifications in various obvious aspects, all without departing from the true spirit and scope of the invention. Accordingly, the drawings and detailed descriptions will be regarded as illustrative in nature and not as unnecessarily restrictive, unless expressly stated otherwise.

DETAILED DESCRIPTION

The following detailed description and the appended drawings describe and illustrate some embodiments of the invention for the purpose of enabling one of ordinary skill in the relevant art to make and use the invention. As such, the detailed description and illustration of these embodiments are purely illustrative in nature and are in no way intended to limit the scope of the invention, or its protection, in any manner. It should also be understood that the drawings are not to scale and in certain instances details have been omitted, which are not necessary for an understanding of the present invention, such as details of fabrication and assembly. In the accompanying drawings, like numerals represent like components.

Figure 1:
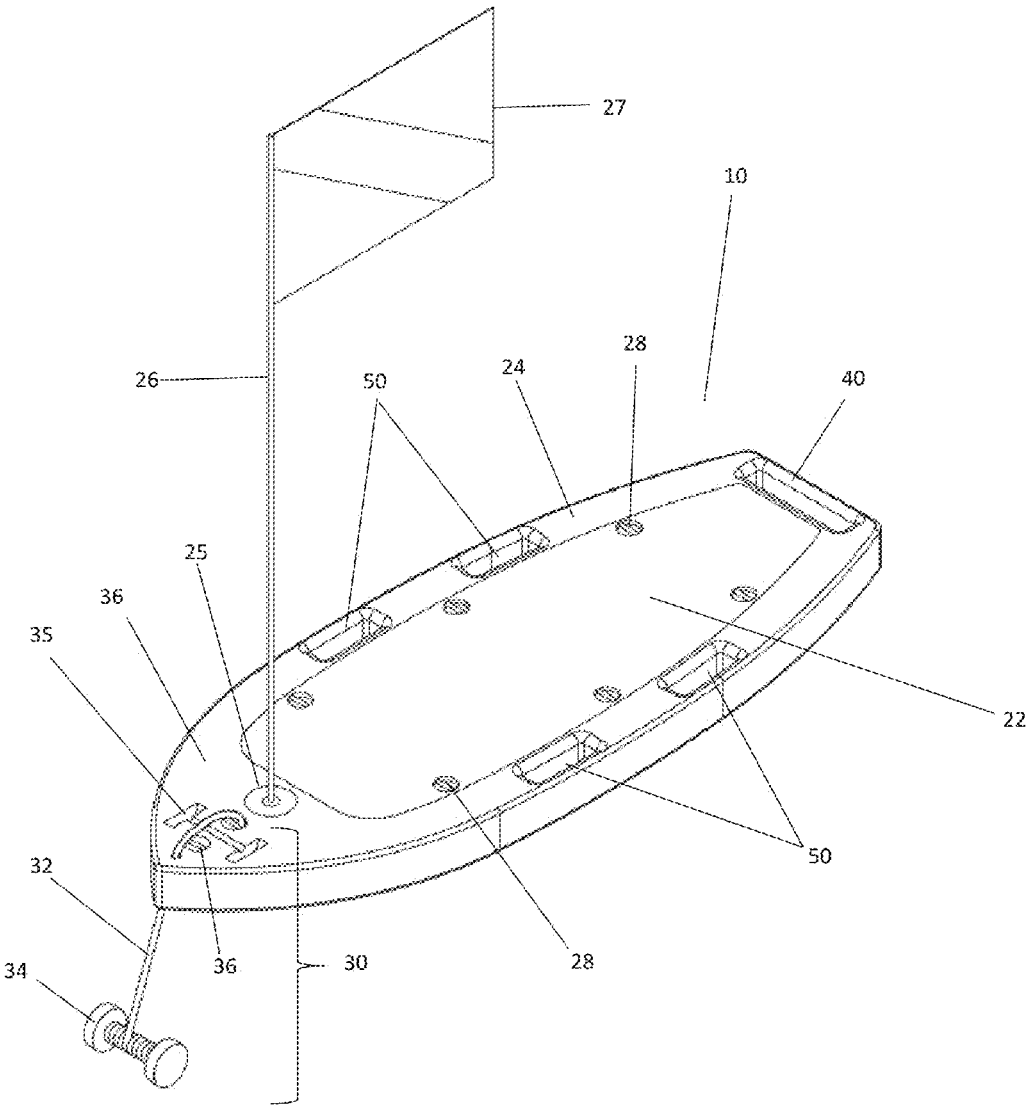
FIG. 1 illustrates a top perspective view of an embodiment of a floating board device in accordance with the disclosure.

With reference to FIG. 1, the top side of a portable floating board 10 is provided as a portable staging area for water sports enthusiasts. A portable floating board 10 may be comprised of a base board 20. The top of the base board 20 may be comprised of an outer board 22 and an inner board 22. The inner board 24 may act as a staging area where a diver, fisherman, or swimmer may sit or stand. The front portion of the outer board 22 may include an anchor 30. The rear portion of the outer board 22 may include a handle bar 40. The edges of the outer board 24 may also include a plurality of pockets 50.

The base board 20 may be composed of buoyant fiberglass and foam core allowing the board to float on the water where a user may use board to paddle to a location. In another embodiment, the base board 20 may be composed of plastic and a foam core. In one embodiment, the base board 20 may be up to twenty one inches wide, up to fifty seven inches in length, and up to three inches in thickness. In another embodiment, the inner board 22 may be composed of a non-skid neoprene surface. The inner board 22 may be up to twenty eight inches in length and up to fifteen inches wide. The buoyant fiberglass may also allow for a staging area or platform for a diver or snorkeler. Additionally, the buoyant board may provide a user a resting platform on the water in between dives or swimming. The user may sit or lie on top of the floating device 10 or may paddle to a new diving or fishing area. In another embodiment, the floating device 10 may allow a user to secure his equipment or supplies on top of the floating board. This may allow a user to use the device to take equipment or supplies to a location on the water or store equipment and supplies while diving or swimming.

Figure 3:
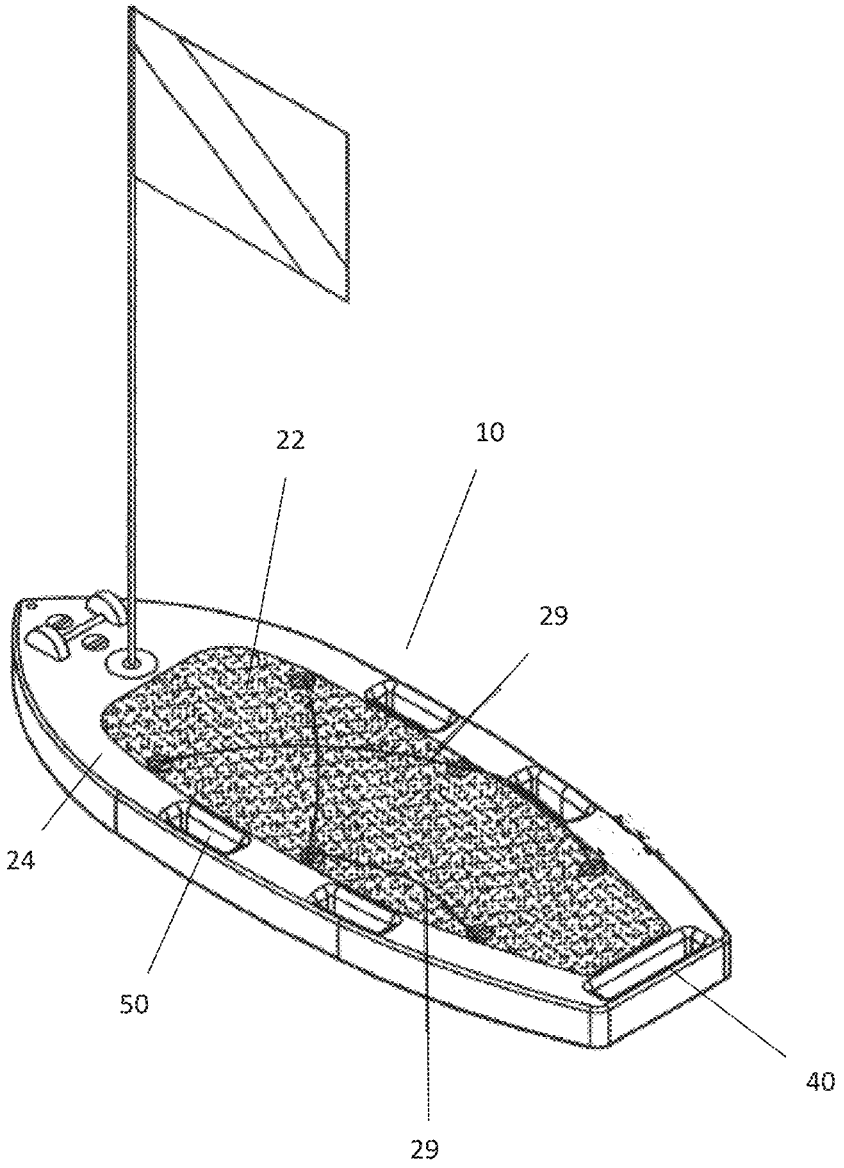
FIG. 3 illustrates a top perspective view of an embodiment of a floating board device in accordance with the disclosure.
Figure 4:
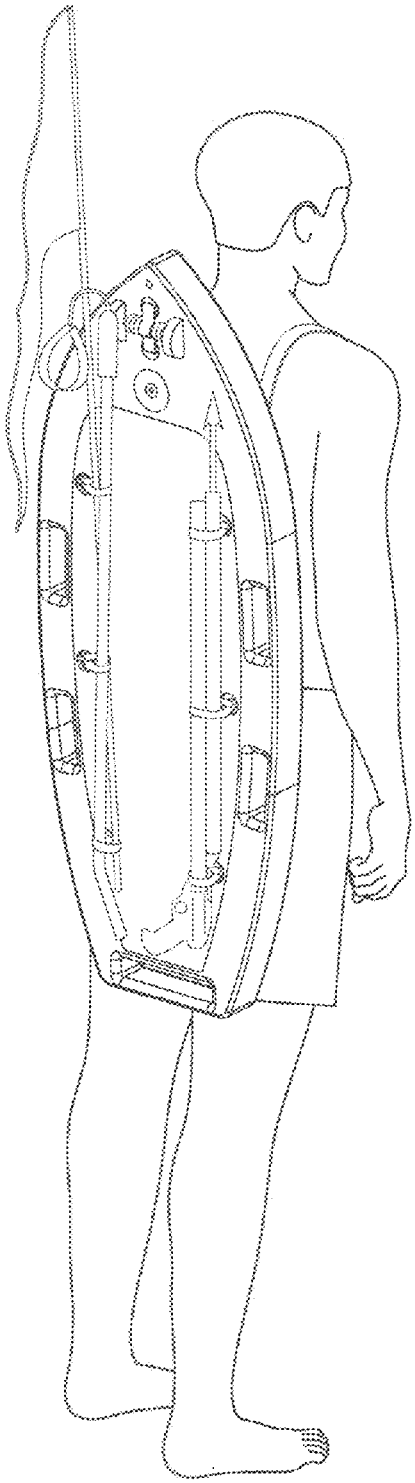
FIG. 4 illustrates a user of the device of FIGS. 1-3 by a user.

The inner board 22 may include a plurality of inner board securing mechanisms 28 that may secure a plurality of straps 29 to secure various equipment, tools, or coolers to the board as seen in FIG. 3. The straps 29 may be nylon VELCRO cords, bungee cords, cables or ropes. In one embodiment, the straps 29 may be secured vertically on the inner board securing mechanisms 28 to hold equipment such as a spear gun as seen in FIG. 4. In this embodiment, the straps 29 may be ten to twelve inches of nylon VELCRO that may be secured to the inner board securing mechanisms 28 and wrap around the item that is being secured such as a spear gun in FIG. 4. In another embodiment, the straps 29 may be secured in a criss-cross pattern across the securing mechanisms 29 as seen in FIG. 4 to secure larger equipment such as a cooler while the floating board 10 is in use. The inner board securing mechanisms 28 may be situated around the outer edge of the inner board 22. The securing mechanisms 28 may be comprised of a recessed cup with a rod placed inside the recessed cup. The rod may made of wood, metal, polyvinyl chloride, or plastic. In another embodiment, the rod may be removable. The straps 29 may attach to the securing mechanisms 28 by creating a loop around the rod that may be tightened. In another embodiment, the straps 29 may also be attached to the securing mechanisms 28 by tying a knot to the rods or by placing a hook at the end of the straps 29.

In another embodiment, on the outer board 22 going towards the front end of the floating board device 10 may include a support insertion 25 where a removable upright support 26 may be inserted in the support insertion 25. In one embodiment, the removable upright support 26 may be up to forty two inches in length. The upright support may also include a safety flag 27. The safety flag 27 may allow a user to easily identify the location of the floating device 10 while swimming or coming up from a dive. In addition, the safety flag 27 may allow other water sports enthusiasts such as boaters, water skiers, and personal watercraft drivers to visibly see the floating device and be aware of its presence to enhance safety. In another embodiments, the removable upright support 26 may be used by a user to balance himself while standing on the floating device. In other embodiments, a spinnaker may be attacked to the upright support that may act as a sail for the floating device.

The top side of the floating board device may also include an anchor system 30. The anchor system 30 may be located on the outer board 22 at the front end of the floating board device 10. The anchor system 30 may comprise of an anchor line 32 and a weight 34. Furthermore, the weight 34 may comprise of a barbell-style weight which may be lowered into the water to stabilize the floating device 10 at a location in the water. The weight 34 may weigh between two to three pounds. The anchor line 32 may be attached to the weight 34 by wrapping or coiling around the weight. The anchor line 32 may be attached to the front edge of the outer board 22 by a plurality of outer board securing mechanisms 36. The anchor line 32 may be also be a cable, nylon, braided nylon, bungee cord, wire, rope, or a string. A user may drop the weight 34 from the anchor system 30 when the user gets to a certain spot in the water to swim, dive, or fish. The anchor system 30 would keep the floating device 10 in a stationary position. In one embodiment, the anchor 30 may be stored in an anchor hole 35 on the top, front end of outer board 22. The anchor line 34 may be between twenty five feet to eighty feet in length. The outer board securing mechanisms 36 may also be used to secure the weight 34 when it is stored in the anchor hole 35.

The plurality of pockets 50 may allow a user to store equipment, supplies, beverages, or food while out in the water. The pockets may be aligned along the outer board 22 and allow for a user in the water to quickly access the equipment or supplies needed while in the water. Furthermore, the pockets 50 may allow multiple swimmers such as children to hold on to the floating device 10 while in the water. In one embodiment, the plurality of pockets 50 may be situated around the sides of the floating board 10. The pockets 50 may be comprised of a recessed portion of the base board 20. In another embodiment the pockets 50 may comprise of a net, a mesh, or a cloth that secures items in the pockets 50.

The handle 40 located on the rear of the top side of the floating device 10 may allow a user to hold onto the floating device 10 while swimming or diving. The handle 40 may also allow a user to carry the floating device 10 outside the water. The handle 40 may be used by a swimmer or diver to drag the floating device 10 while in the water. In addition, a swimmer may use the handle 40 to push or drag the floating device 10 while someone, such as a child, is on the floating device 10. In another embodiment, a line may be attached to the handle 40 and used as a life ring in emergency situations. In another embodiment, the handle 40 may comprise of a plurality of handles.

Figure 2:
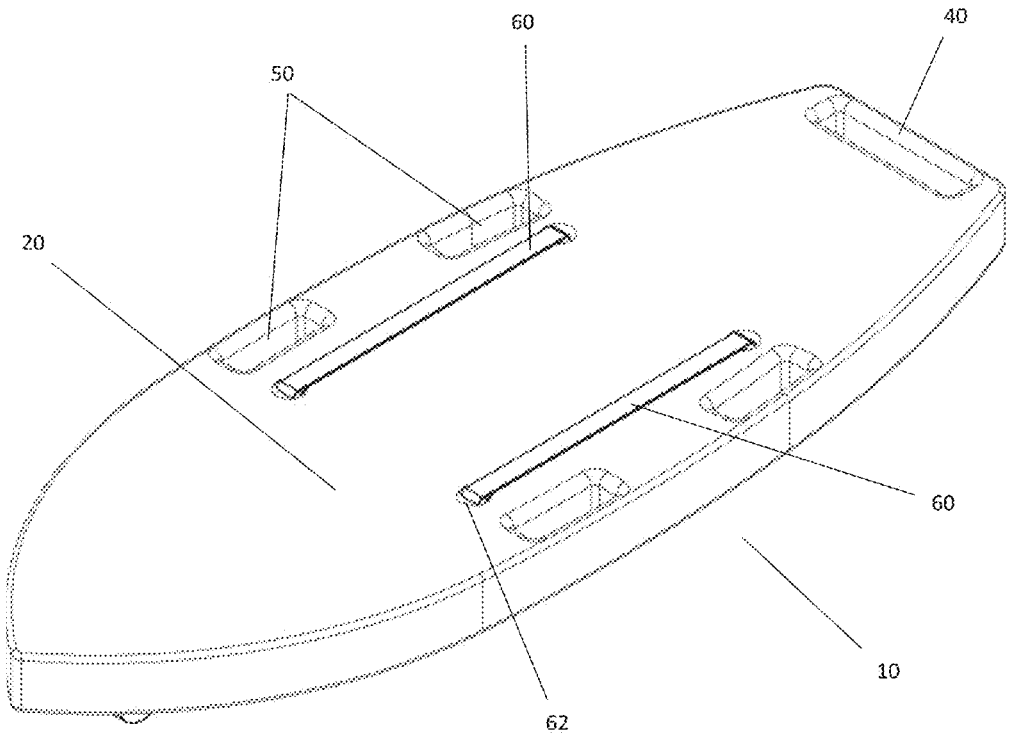
FIG. 2 illustrates a bottom perspective view of an embodiment of a floating board device in accordance with the disclosure.

FIG. 2 illustrates another embodiment of the floating device 10. The floating device may comprise of a plurality of shoulder straps 60 on a bottom side of the base board 20. The shoulder straps 60 may be composed of nylon VELCRO, plastic, rope, bungee cord, or rubber. The shoulder straps 60 may be adjustable and may be padded for comfort. The shoulder straps 60 may allow a user to carry the floating device 10 over the shoulders or over the back like a backpack. The shoulder straps 60 may be secured by a plurality of bottom securing mechanisms 62 located on the bottom of the base board 20. In one embodiment, the shoulder straps 60 may be up to thirty six inches long. The shoulder straps 60 may be adjustable to fit with a user's body and comfort.

Figure 5:
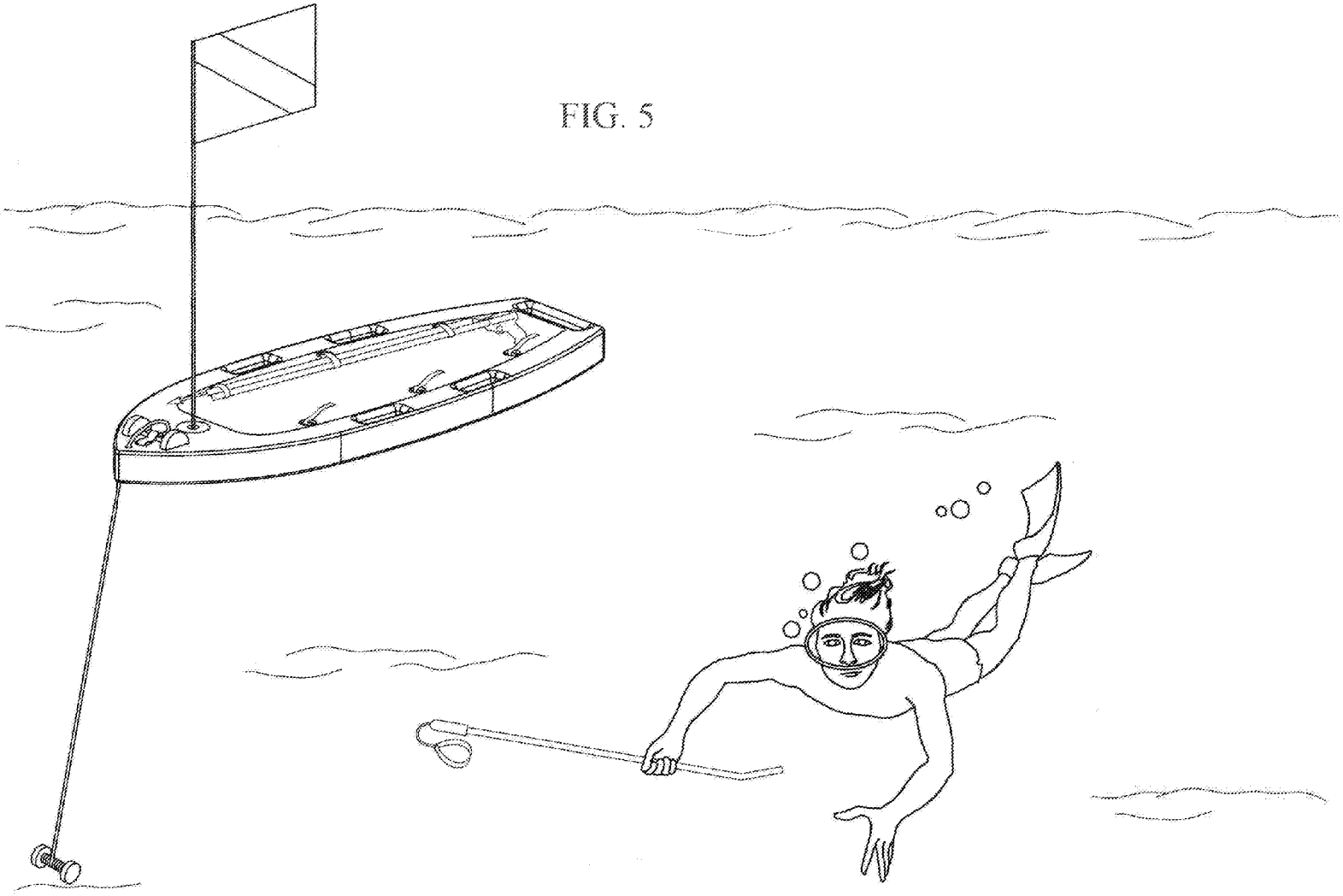
FIG. 5 illustrates a user of the device of FIGS. 1-3 by a user.

FIGS. 4 and 5 illustrates embodiments of the floating device 10 of a user carrying the floating device 10 and a user diving in the water while the floating device 10 is on the water.

The descriptions set forth above are meant to be illustrative and not limiting. Various modifications of the invention, in addition to those described herein, will be apparent to those skilled in the art from the foregoing description. Such modifications are also intended to fall within the scope of the concepts described herein. The disclosures of each patent, patent application and publication cited or described in this document are hereby incorporated herein by reference, in their entireties.

The foregoing description of possible implementations consistent with the present disclosure does not represent a comprehensive list of all such implementations or all variations of the implementations described. The description of some implementation should not be construed as an intent to exclude other implementations. For example, artisans will understand how to implement the invention in many other ways, using equivalents and alternatives that do not depart from the scope of the invention. Moreover, unless indicated to the contrary in the preceding description, none of the components described in the implementations are essential to the invention. It is thus intended that the embodiments disclosed in the specification be considered as illustrative, with a true scope and spirit of the invention being indicated by the following claims.

What is claimed is:

1. A floating board device for swimming and underwater diving comprising:

rigid base board comprised of a buoyant material as a staging and resting platform for swimmers and divers having a top side and a bottom side wherein the top side comprises of an outer board and an inner board with a non-skid neoprene surface for a user to sit or lie on the base board or place items on the base board during underwater dives or while swimming;

a handle bar located along a rear edge of the base board;

a plurality of recessed pockets located along the outer board;

a plurality of inner board securing mechanisms located on the inner board;

a support insertion wherein a removable upright support may be inserted into the support insertion and the removable upright support comprises of a diver-down safety flag;

an anchor system having an anchor line, a weight, an anchor hole, and a plurality of outer securing mechanisms wherein the anchor hole is located on the top side at a front end of the outer board and allows the weight to be stored on the base board and secured by the outer securing mechanisms;

and a plurality of shoulder straps located on the bottom side of the base board.

2. The floating board device of claim 1, wherein the base board comprises a buoyant fiberglass.

3. The floating board device of claim 1, wherein the base board may be up to fifty seven inches in length, up to twenty one inches in width, and up to three inches in thickness.

* * * * *